US010995569B2

(12) United States Patent
Helms et al.

(10) Patent No.: US 10,995,569 B2
(45) Date of Patent: May 4, 2021

(54) SENSOR SYSTEM FOR TONG ASSEMBLY

(71) Applicant: Weatherford Technology Holdings, LLC, Houston, TX (US)

(72) Inventors: Martin Helms, Burgdorf (DE); Jan Rothe, Hannover (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 86 days.

(21) Appl. No.: 16/109,414

(22) Filed: Aug. 22, 2018

(65) Prior Publication Data

US 2020/0063506 A1 Feb. 27, 2020

(51) Int. Cl.

| | |
|---|---|
| ***E21B 19/16*** | (2006.01) |
| ***E21B 47/00*** | (2012.01) |
| *E21B 17/042* | (2006.01) |
| *E21B 17/00* | (2006.01) |

(52) U.S. Cl.

CPC ..... *E21B 19/161* (2013.01); *E21B 19/16* (2013.01); *E21B 47/00* (2013.01); *E21B 17/006* (2013.01); *E21B 17/042* (2013.01); *E21B 19/165* (2013.01)

(58) Field of Classification Search

CPC .... E21B 17/006; E21B 17/042; E21B 19/161; E21B 19/164; E21B 19/165; E21B 47/00

See application file for complete search history.

(56) References Cited

U.S. PATENT DOCUMENTS

| | | | | |
|---|---|---|---|---|
| 8,025,024 | B2 | 9/2011 | Halse | |
| 8,100,174 | B2 | 1/2012 | Halse | |
| 9,061,868 | B1 * | 6/2015 | Paulsen | B66C 1/0218 |
| 9,657,539 | B2 | 5/2017 | Gupta et al. | |
| 2005/0133115 | A1 * | 6/2005 | Gatz | A01G 23/08 144/357 |
| 2007/0074606 | A1 * | 4/2007 | Halse | E21B 19/164 81/57.16 |
| 2008/0202813 | A1 * | 8/2008 | Anthony | E21B 19/10 175/52 |
| 2009/0038789 | A1 * | 2/2009 | Carstensen | E21B 19/164 166/77.51 |
| 2010/0132180 | A1 | 6/2010 | Conquergood et al. | |

(Continued)

FOREIGN PATENT DOCUMENTS

| | | |
|---|---|---|
| CN | 105545231 A | 5/2016 |

OTHER PUBLICATIONS

PCT International Search Report and Written Opinion dated Nov. 12, 2019, for International Application No. PCT/US2019/047323.

*Primary Examiner* — Robert E Fuller
*Assistant Examiner* — Christopher J Sebesta
(74) *Attorney, Agent, or Firm* — Patterson + Sheridan, LLP

(57) ABSTRACT

A method of connecting or disconnecting a first tubular to a second tubular includes engaging the first tubular with a power tong; engaging the second tubular with a backup tong; and rotating the first tubular relative to the second tubular. The method also includes, while rotating, monitoring a distance between the backup tong and the power tong and comparing the distance to a first threshold value; and stopping rotation of the first tubular when the distance equals to the first threshold value. According to one embodiment, a tong assembly includes a power tong, a backup tong, a sensor configured to measure a distance between the power tong and the backup tong, and a controller configured to compare the distance to a threshold value.

12 Claims, 6 Drawing Sheets

(56) References Cited

U.S. PATENT DOCUMENTS

| | | | | |
|---|---|---|---|---|
| 2014/0224755 | A1* | 8/2014 | Eriksson | B66C 13/06 212/273 |
| 2015/0101826 | A1* | 4/2015 | Gupta | E21B 19/164 166/377 |
| 2015/0176349 | A1* | 6/2015 | Belik | E21B 19/16 285/27 |
| 2018/0179833 | A1 | 6/2018 | Richardson et al. | |

* cited by examiner

SENSOR SYSTEM FOR TONG ASSEMBLY

BACKGROUND

Field

Embodiments of the present disclosure generally relate to apparatus and methods for making up and breaking out threadedly connected tubular members, and more particularly to a system for monitoring distance between tongs for making up and breaking out a connection.

Description of the Related Art

In many stages of the drilling and completion of an oil and gas well, tubular members are coupled end-to-end to form what is known as a string. Typically, tubular members are made up in approximately 30-90 foot segments known as pipe stands, and include threaded couplings at each end. Commonly known as box and pin connections for the female and male portions, respectively, the threaded connections serve to both form a fluid seal between the tubular segments and to resiliently couple the adjacent tubulars.

When making up a drill string, multiple rotations of one of the tubulars are required to fully engage the threads of the box with the threads of the pin. Tongs are used to deliver torque to a set of jaws that grip the tubulars being threaded together. A power tong is used to deliver torque and rotation to one of the tubulars while a backup tong maintains the other tubular rotationally stationary. During makeup of a threaded connection, the power tong moves towards the backup tong as the tubulars are threaded together. In order to account for the threading together of the tubular members, the power tong needs to move a fixed distance known as the makeup loss. The makeup loss is determined based on the characteristics of the tubulars members, such as pipe size and thread type.

If the distance between the backup tong and the power tong is not sufficient to account for the makeup loss, the backup tong and power tong will collide unless the makeup operation is stopped. Likewise, the makeup loss must be accounted for when the power tong moves away from the backup tong when breaking out a threaded connection. Typically, axial limits of the power tong actuator prevent further movement of the power tong away from the backup tong at an upper limit. If the distance between the backup tong and the upper limit is not sufficient to account for the makeup loss during break out, the power tong will cease movement away from the backup tong, resulting in damage to the threaded connection.

Therefore, there is a need for improved methods and apparatus for monitoring distance between tongs for making up and breaking out a connection.

SUMMARY

The present disclosure generally relates to apparatus and methods for making up and breaking out threadedly connected tubular members, and more particularly to a system for monitoring distance between tongs for making up and breaking out a connection.

In one embodiment, a method of connecting or disconnecting a first tubular to a second tubular includes engaging the first tubular with a power tong; engaging the second tubular with a backup tong; and rotating the first tubular relative to the second tubular. The method also includes, while rotating, monitoring a distance between the backup tong and the power tong and comparing the distance to a first threshold value; and stopping rotation of the first tubular when the distance equals to the first threshold value.

In another embodiment, a method of connecting or disconnecting a first threaded tubular to a second threaded tubular includes engaging the first threaded tubular with a power tong, engaging the second threaded tubular with a backup tong, moving the power tong axially relative to the backup tong while rotating the first threaded tubular relative to the second threaded tubular; measuring a distance between the backup tong and the power tong; comparing the distance to a first threshold value; and stopping axial movement of the power tong when the distance reaches the first threshold value.

According to one embodiment, a tong assembly includes a power tong, a backup tong, a sensor configured to measure a distance between the power tong and the backup tong, and a controller configured to compare the distance to a threshold value.

Another embodiment of the present disclosure is a non-transitory computer readable medium including instructions, that when executed by one or more processors, executes a method of connecting or disconnecting a first tubular to a second tubular includes engaging the first tubular with a power tong; engaging the second tubular with a backup tong; and rotating the first tubular relative to the second tubular. The method also includes, while rotating, monitoring a distance between the backup tong and the power tong and comparing the distance to a first threshold value; and stopping rotation of the first tubular when the distance equals to the first threshold value.

Another embodiment of the present disclosure is a non-transitory computer readable medium including instructions, that when executed by one or more processors, executes a method of connecting or disconnecting a first threaded tubular to a second threaded tubular includes engaging the first threaded tubular with a power tong, engaging the second threaded tubular with a backup tong, moving the power tong axially relative to the backup tong while rotating the first threaded tubular relative to the second threaded tubular; measuring a distance between the backup tong and the power tong; comparing the distance to a first threshold value; and stopping axial movement of the power tong when the distance reaches the first threshold value.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1:
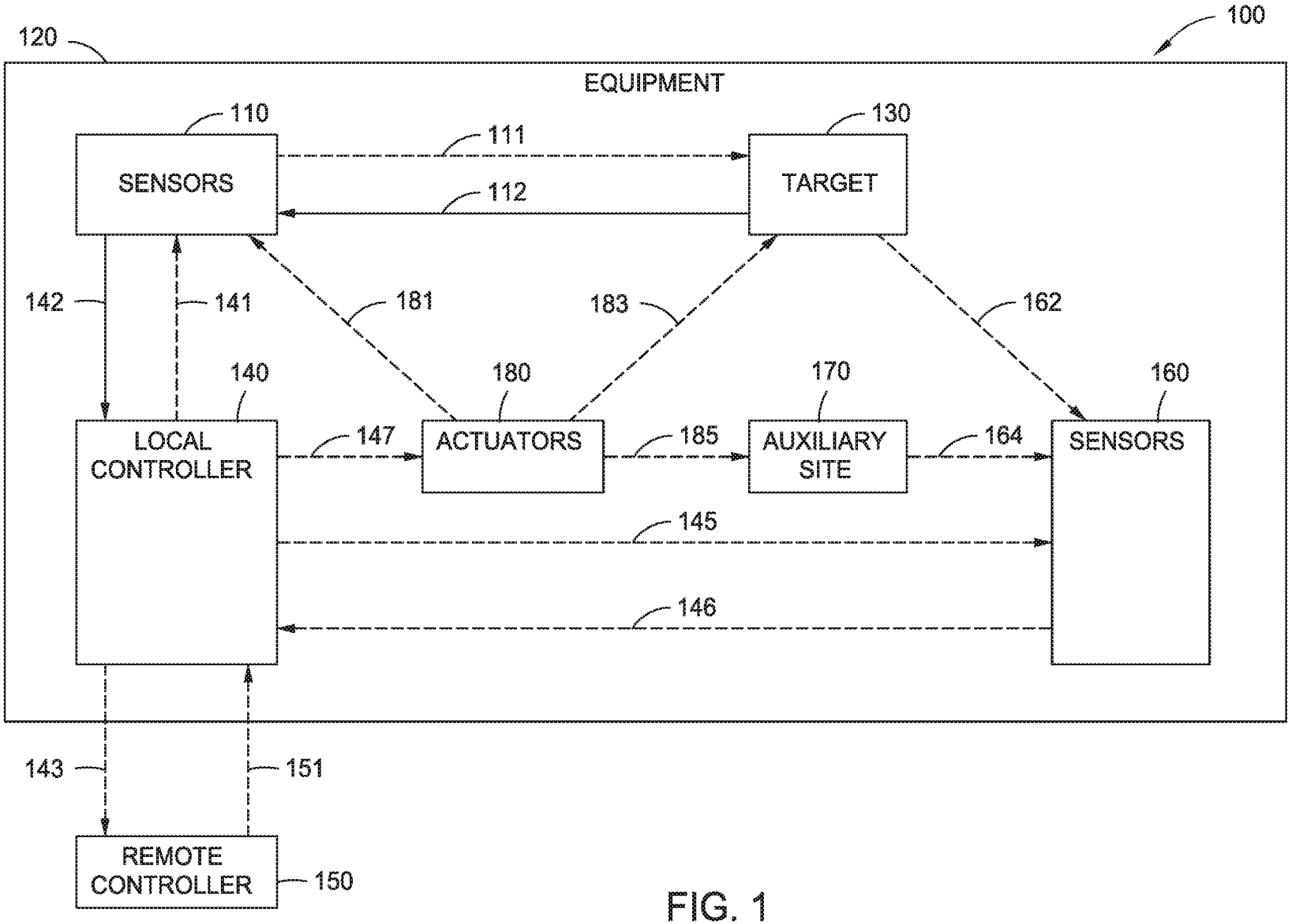
FIG. 1 illustrates an exemplary sensor system for a tong assembly.

An exemplary sensor system 100 is illustrated in FIG. 1. In the illustrated embodiment, one or more sensors 110 are located on equipment 120 (e.g., a tong assembly, power tong, and/or backup tong) on a rig. Exemplary sensors 110 include cable-actuated sensors, optical imaging devices, optical devices such as laser measurement devices, ultrasonic sensors, etc. The sensors 110 may be configured to measure and/or monitor a distance between the power tong and the backup tong. The sensors 110 are positioned to be able to detect measurements 112 about a target 130 on equipment 120. A local controller 140 is also located on the equipment 120. The local controller 140 is functionally connected to the sensor 110. In some embodiments, the local controller 140 is able to send commands 141 to the sensor 110, and the sensor 110 is able to receive commands. In some embodiments, the local controller is able to receive information 142 from the sensor 110, and the sensor 110 is able to send information 142. For example, the information 142 may be a signal in response to detection of the target 130 by the sensor 110. As another example, the information 142 may be an optical image, resulting from image processing or object detection, the measured and/or monitored distance between the power tong and the backup tong, etc. In some embodiments, the local controller 140 is able to store, analyze, and/or retransmit the information 142 received from the sensor 110.

In some embodiments, the local controller 140 is able to send data 143 to a remote controller 150, and remote controller 150 is able to receive data 143. For example, the local controller is able to retransmit the information 142 as data 143. In some embodiments, the local controller 140 analyzes and/or processes the information 142, and the local controller 140 sends the results as data 143. The data 143 may be for example, the measured and/or monitored distance between the backup tong and the power tong. The remote controller 150 may be remote from the equipment 120. For example, the remote controller 150 is located in a control room of the rig, or the remote controller is at a location that is remote from the rig. The remote controller 150 may receive data 143 from the local controller 140 and/or other inputs (e.g., operator input, input from other systems on the rig, etc.). The remote controller 150 may analyze and/or process the data 143 and/or other inputs. The remote controller 150 may be able to send control commands 151 to local controller 140, and local controller 140 may be able to receive commands 151. Data, inputs, commands, and/or signals may be sent between local controller 140 and remote controller 150 over a variety of communication channels, including, for example, wires, fiber optics, hydraulic lines, pneumatic lines, and/or wirelessly, including electromagnetic or acoustic signaling.

In some embodiments, local controller 140 is functionally connected with other sensors 160 on equipment 120. The other sensors 160 are differentiated from the sensors 110. In some embodiments, the other sensors 160 acquire measurements about the operation of the equipment 120. For example, the other sensors 160 may include torque sensors, pressure sensors, etc. In some embodiments, the other sensors 160 acquire measurements about one or more auxiliary sites 170 on the equipment 120. In some embodiments, the local controller 140 is able to send commands 145 to the other sensors 160, and the other sensors 160 are able to receive commands 145. In some embodiments, the local controller 140 is able to receive information 146 from the other sensors 160, and the other sensors 160 are able to send information 146. In some embodiments, the local controller 140 is able to store, analyze, and/or retransmit the information 146 received from the other sensors 160. For example, the local controller analyzes information 142 from sensors 110 in combination with information 146 from the other sensors 160.

In some embodiments, local controller 140 is functionally connected with actuators 180 on equipment 120. For example, in some embodiments, the local controller 140 is able to send commands 147 (e.g., control signals) to the actuators 180, and the actuators 180 may be able to receive commands 147. The commands 147 may be based on, or in response to, the information 142, information 146, and/or analysis of information 142/146. In some embodiments, the commands 147 instruct the actuators 180 to cause action 181 (e.g., stopping rotation of the power tong and/or backup tong, stopping longitudinal movement of the power tong) at the equipment 120.

Figure 2:
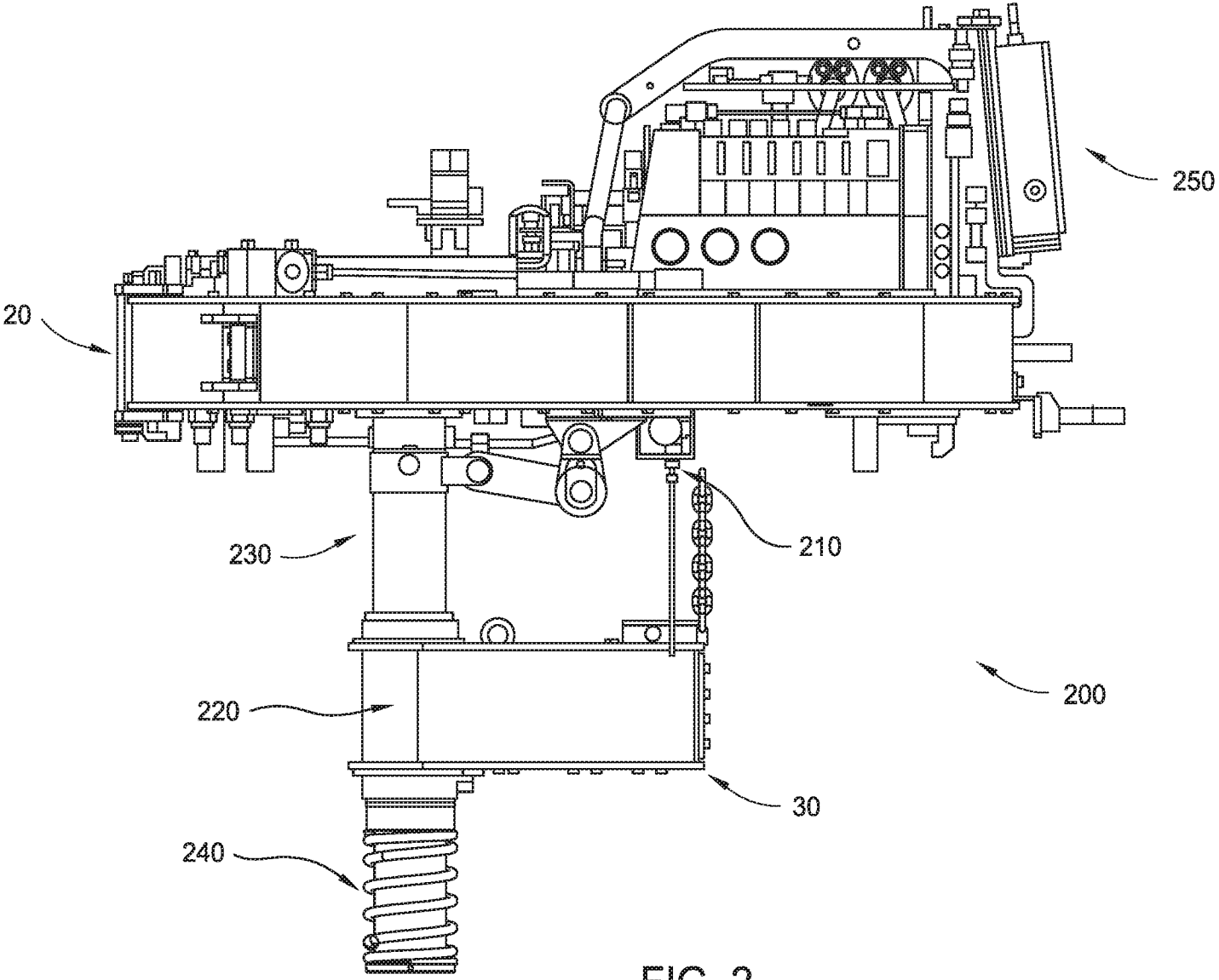
FIG. 2 illustrates another exemplary sensor system for a tong assembly.

Another exemplary sensor system 200 is illustrated in FIG. 2. The sensor system 200 may assist during operation of a tong assembly to makeup a tubular connection.

The sensor system 200 may be mounted on a tong assembly. In one embodiment, the tong assembly may be coupled to and moved by a positioning system, such as a power arm. The tong assembly includes a power tong 20 and a backup tong 30. The power tong 20 is configured to receive a pin end of a tubular joint and to engage and grip the pin end of the tubular joint. The backup tong 30 is configured to receive a box end of a tubular string and to engage and grip the box end of the tubular string. The power tong 20 and the backup tong 30 may be used to makeup or breakout a connection between the tubular joint and the tubular string.

The sensor system 200 may detect a distance between the power tong 20 and the backup tong 30. In FIG. 2, the backup tong 30 is shown in a neutral position. During operation of the tong assembly, the relative position between the power tong 20 and the backup tong 30 may be in a continuous range 220 between the upper limit 230 and the lower limit 240. For example, as the tubular joint is lowered during makeup, the power tong 20 will move lower and closer to the backup tong 30. The sensor system 100 may monitor the distance between the power tong 20 and the backup tong 30. If the backup tong 20 reaches the upper limit 230, damage may result to the power tong 20, backup tong 30, or other components of the tong assembly. In some instances, damage to the tubular connection could also occur. Similarly, during breakout, the power tong 20 will move higher and away from the backup tong 30. As a result, the backup tong 30 will move closer to the lower limit 240, which be determined by monitoring the distance between the power tong 20 and the backup tong 30. The sensor system 200 may be configured to stop the operation of the tong assembly if the backup tong 30 approaches either of the upper limit 230 or lower limit 240.

In one embodiment, the sensor system 200 includes a sensor 210. The sensor 210 may be a cable actuated sensor. The cable actuated sensor may span the distance between the power tong 20 and the backup tong 30. In some embodiments, a reel of the cable actuated sensor is mounted to an underside of the power tong 20. An end opposite the reel is mounted to the top of the backup tong 30. In some embodiments, the reel is mounted to the top of the backup tong 30 and the end opposite the reel is mounted to the underside of the power tong 20. The cable actuated sensor may have a length slightly greater than the upper and lower limits of movement of the tong assembly. For example, the cable actuated sensor may have a length of cable five to ten percent greater than, or three to twenty percent greater than, the upper and lower limits of movement of the tong assembly. The cable actuated sensor may be configured to feed out or retract a length of cable in response to relative movement between the power tong 20 and the backup tong 30. For example, as the power tong 20 moves away from the backup tong 30 while breaking out a tubular connection, the reel of the cable actuated sensor may feed out a corresponding length of cable equal to the distance moved by the power tong 20.

The sensor 210 may be functionally connected to local controller 250. Local controller 250 may be able to send data to and/or receive commands from a remote controller. The location of sensor 210 on the tong assembly may be changed according to operational and/or manufacturing specifications.

During operation, the sensor 210 may monitor and/or measure a distance between the backup tong 30 and the power tong 20. The local controller 250 may be able to receive information from the sensor 210. The information may include the monitored and/or measured distance between the backup tong 30 and the power tong 20. The information may be analyzed to determine further information. In some embodiments, the local controller 250 transmits the information to a remote controller. The remote controller may be able to receive information from the local controller 250. In some embodiments, the local controller 250 may calculate the distance between the backup tong 30 and the power tong 20. For example, the sensor 210 may transmit information regarding the speed of emitted sound waves and the time it takes for sound waves to return. Based on the information, the local controller 250 may calculate the measured and/or monitored distance between the backup tong 30 and the power tong 20. In some embodiments, the remote controller may calculate the measured and/or monitored distance between the backup tong 30 and the power tong 20 based on the information.

In some embodiments, the local controller 250 may stop operation of the tong assembly if the backup tong 30 approaches either the upper limit 230 or the lower limit 240. For example, the local controller 250 can analyze the information from the sensor 210, and the local controller 250 can calculate and compare the measured and/or monitored distance to a first threshold value. The first threshold value may correspond to the upper limit 230 of movement or the lower limit 240 of movement. In some embodiments, the first threshold value may be within a predetermined range, such as within an inch, or within a range of 0.5 inches to two inches, of the upper limit 230 or the lower limit 240. In some embodiments, if the local controller 250 determines the measured and/or monitored distance is equal or greater than the first threshold value, then the local controller 250 can instruct the tong assembly to stop operation, thereby stopping rotation of the first threaded tubular relative to the second threaded tubular.

In some embodiments, the first threshold value corresponds to a manufacturer's specification. The manufacturer's specification may be based on the tubular specification, tong assembly specification, or a combination thereof. In some embodiments, the local controller 250 calculates and compares the measured and/or monitored distance to the first threshold value. In some embodiments, if the local controller 250 determines the measured and/or monitored distance is equal or greater than the first threshold value, then the local controller 250 can determine the tubular connection is close to makeup or breakout based on the tubular specification, tong assembly specification, or a combination thereof. In some embodiments, the local controller 250 determines the remaining distance required for makeup or breakout based on the tubular specification, tong assembly specification, or a combination thereof. The local controller 250 can compare the determined remaining distance required with the measured and/or monitored distance between the backup tong 30 and the power tong 20. If the determined remaining distance is less than the distance between the tongs 20, 30, then the local controller 250 may instruct the tong assembly to continue operation. If the determined remaining distance is greater than the distance between the tongs 20, 30, then the local controller 205 may instruct the tong assembly to stop operation.

In some embodiments, the sensor system 200 measures the distance between the backup tong 30 and the power tong 20 before beginning rotation of the tubulars. The sensor 210 may transmit information to the local controller 250 to calculate the distance between the backup tong 30 and the power tong 20. The local controller 250 may compare the measured distance to a first threshold value. The first threshold value may correspond to a manufacturer's specification, such as the distance required to makeup or breakout a connection between a first tubular and a second tubular. In some embodiments, if the local controller 250 determines the measured distance is equal to or greater than the first threshold value, then the local controller 250 can instruct the tong assembly to begin operation by rotating the first threaded tubular relative to the second threaded tubular. In some embodiments, if the local controller 250 determines the measured distance is less than the first threshold value, then the backup tong 30 is repositioned to increase the distance between the power tong 20 and the backup tong 30. In some embodiments, the sensor system can measure the distance between the new position of the backup tong 30 and the power tong 20. If the local controller 250 determines the new distance is greater than or equal to the first threshold value, then the local controller 250 can instruct the tong assembly to begin operation.

In some embodiments, slippage between the power tong 20 and/or backup tong 30 and the tubulars may occur. As a result, the initial comparison and determination based on the first threshold value made by the local controller 250 may now be incorrect. In some embodiments, the sensor system 200 measures and/or monitors the distance between the backup tong 30 and the power tong 20 and compares the measured and/or monitored distance to a second threshold value. The second threshold value may correspond to the upper limit 230 of movement or lower limit 240 of movement. The second threshold value may be within an inch, or within a range of 0.5 inches to 2 inches, of the upper limit 230 or lower limit 240. In some embodiments, the second threshold value is equal to the upper limit 230 or lower limit 240. In some embodiments, the local controller 250 receives information from the sensor 210, and the local controller 250 determines the measured and/or monitored distance between the backup tong 30 and the power tong 20. The local-controller 250 can compare the measured and/or monitored distance to the second threshold value. The local controller 250 may instruct the tong assembly to stop operation if the distance between the tongs is equal to or greater than the second threshold value, thereby stopping rotation of the tubulars. If the distance between the tongs is less than the second threshold value, then the local controller 250 may instruct the tong assembly to continue operation.

In another embodiment, the sensor 210 is an ultrasonic sensor. In some embodiments, the ultrasonic sensor is mounted to the underside of the power tong 20. In some embodiments, the ultrasonic sensor is oriented towards a top of the backup tong 30. The ultrasonic sensor may be configured to emit and receive sound waves. For example, the ultrasonic sensor emits sound waves from a position on the underside of the power tong 20 towards a top of the backup tong 30. The sound waves reflect off the surface of the backup tong 30 and back towards the ultrasonic sensor. A receiver of the ultrasonic sensor may receive the returning sound waves. In some embodiments, the ultrasonic sensor determines a distance between the backup tong 30 and the power tong 20. For example, the ultrasonic sensor emits sound waves and measures the time in which it takes reflected sound waves to return. The sensor 210 or local controller 250 may analyze the information and calculate a distance between the backup tong 30 and the power tong 20 based on the speed of the emitted sound waves and the time it takes for the reflected sound waves to return.

In another embodiment, the sensor system 100 includes an optical imaging device. Exemplary optical imaging devices include cameras, 3D cameras, high speed cameras, time lapse cameras, infrared cameras, light detector, charged-coupled device, wide-angled lens camera, high resolution camera, time-of-flight camera, stop motion camera, motion picture camera, etc. The optical imaging device may be positioned to be able to capture an optical image of a focus area. For example, if the optical imaging device utilizes visible light to capture an optical image, then the optical imaging device is positioned to have a clear line of sight to the focus area. In some embodiments, as part of capturing the optical image, the optical imaging device may emit energy (e.g., focusing light) towards the focus area. In some embodiments, the optical imaging device may have a light source (e.g., flasher) to emit the energy. A light source on the optical imaging device may improve the reliability to properly identify targets regardless of the presence of additional or different lights in the rig environment. The optical imaging device may then capture an optical image, either responsive to the emission of energy, or of the focus area in a native state (without prompting from the optical imaging device). In some embodiments, the optical image may be a series of images captured over time (e.g., as with a motion picture camera). In some embodiments, the optical imaging device may be capable of performing image processing and/or object detection.

Figure 3:
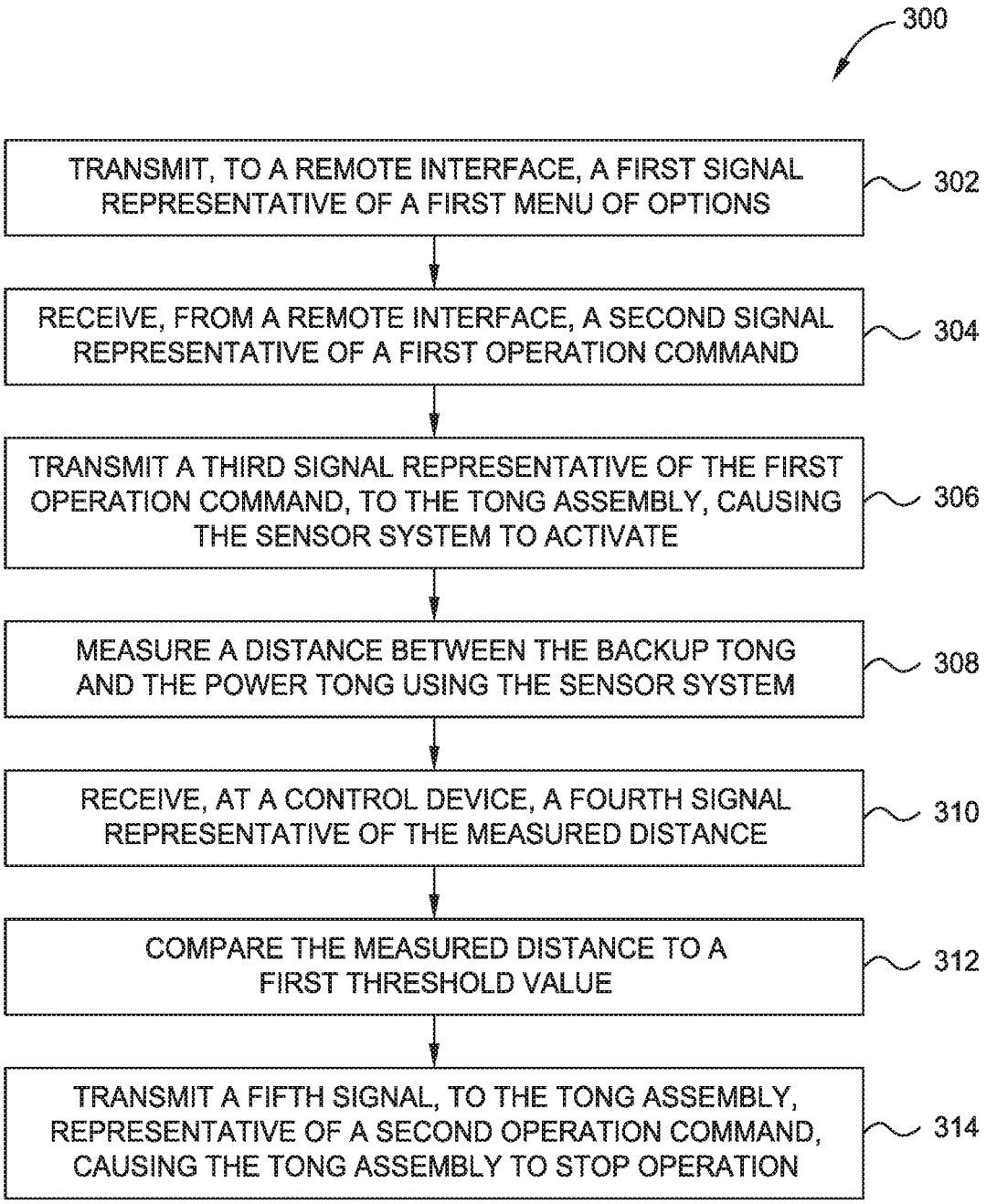
FIG. 3 illustrates an exemplary method utilizing a sensor system for a tong assembly.

FIG. 3 illustrates exemplary operations 300 that may be performed, for example, by a control device, such as local controller 140, to control the tong assembly at a work location, in accordance with embodiments of the present disclosure. Operations 300 begin at 302, where the control device transmits a first signal representative of a menu of options to a remote interface, such as remote controller 150. The menu of options may, for example, represent operation commands for the tong assembly. At 304, the control device receives from the remote interface a second signal representative of a first operation command. At 306, the control device transmits a third signal representative of the first operation command to the tong assembly, which may cause the sensor system to activate. At 308, the sensor system measures a distance between the backup tong 30 and the power tong 20. At 310, the control device receives a fourth signal from the sensor system representative of the measured distance. At 312, the control device compares the measured distance to a first threshold value. At 314, the control device transmits a fifth signal to the tong assembly based on the comparison. If the measured distance is less than the threshold value, then the control device causes the tong assembly to operate and rotate the tubulars to make or break a connection. If the measured distance is equal to or greater than the threshold value, then the control device causes the tong assembly to stop operation. The fifth signal may be representative of a second operation command.

Figure 4:
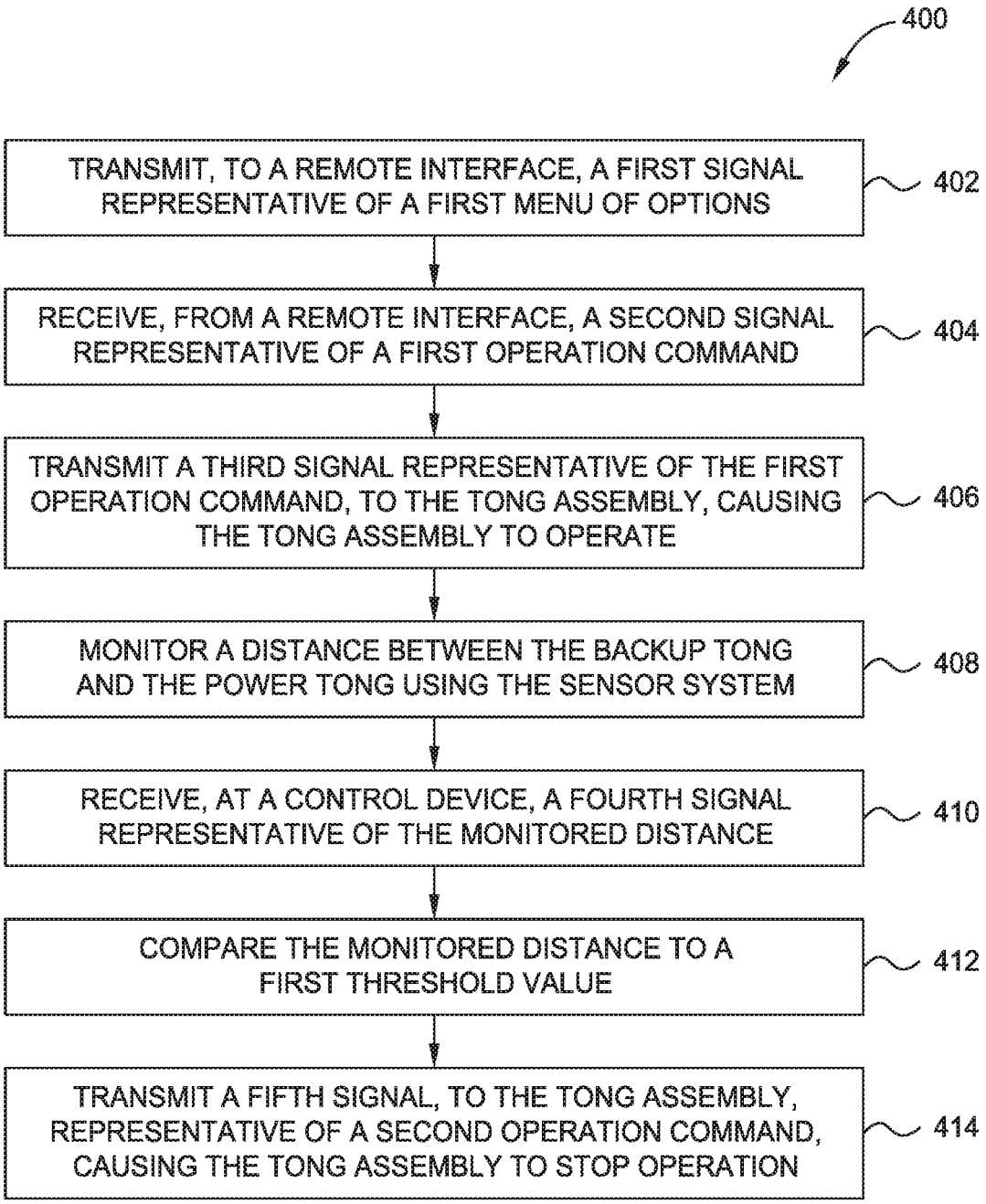
FIG. 4 illustrates another exemplary method utilizing a sensor system for a tong assembly.

FIG. 4 illustrates operations 400 that may be performed, for example, by a control device, such as local controller 140, to control the tong assembly at a work location, in accordance with embodiments of the present disclosure. Operations 400 may begin at 402, where the control device transmits a first signal representative of a menu of options to a remote interface, such as remote controller 150. The menu of options may, for example, represent operation commands for the tong assembly. At 404, the control device receives from the remote interface a second signal representative of a first operation command. At 406, the control device transmits a third signal representative of the first operation command to the tong assembly, which may cause the tong assembly to operate and rotate the tubulars to make or break a connection. At 408, the sensor system monitors a distance between the backup tong 30 and the power tong 20. At 410, the control device receives a fourth signal from the sensor system representative of the monitored distance. At 412, the control device compares the monitored distance to a first threshold value. At 414, the control device transmits a fifth signal representative of a second operation command, which may cause the tong assembly to stop operation and rotation of the tubulars to make or break a connection.

Figure 5:
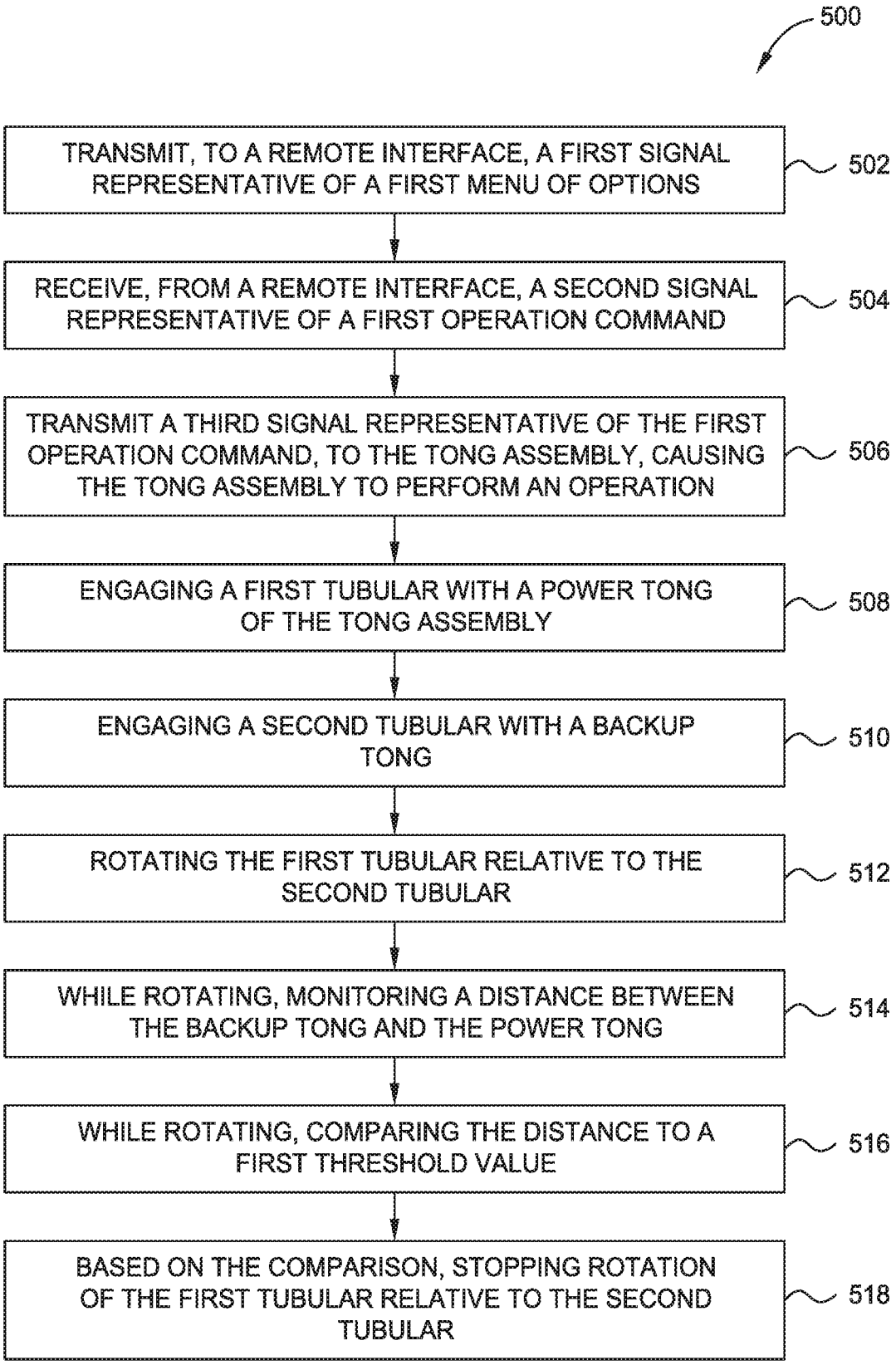
FIG. 5 illustrates another exemplary method utilizing a sensor system for a tong assembly.

FIG. 5 illustrates operations 500 that may be performed, for example, by a control device, such as local controller 140, to control the tong assembly at a work location, in accordance with embodiments of the present disclosure. Operations 500 may begin at 502, where the control device transmits a first signal representative of a menu of options to a remote interface, such as remote controller 150. The menu of options may, for example, represent operation commands for the tong assembly. At 504, the control device receives from the remote interface a second signal representative of a first operation command. At 506, the control device transmits a third signal representative of the first operation command to the tong assembly, which may cause the tong assembly to operate and rotate the tubulars to make or break a connection. At 508, the power tong may engage a first tubular. At 510, the backup tong may engage a second tubular. At 512, the tong assembly may rotate the first tubular relative to the second tubular. At 514, while rotating, the sensor system monitors a distance between the backup tong and the power tong. At 516, while rotating, the control device compares the monitored distance to a first threshold value. At 518, the control device transmits a fifth signal to the tong assembly based on the comparison, which may cause the tong assembly to operate and rotate the tubulars to make or break a connection. The fifth signal may be representative of a second operation command.

Figure 6:
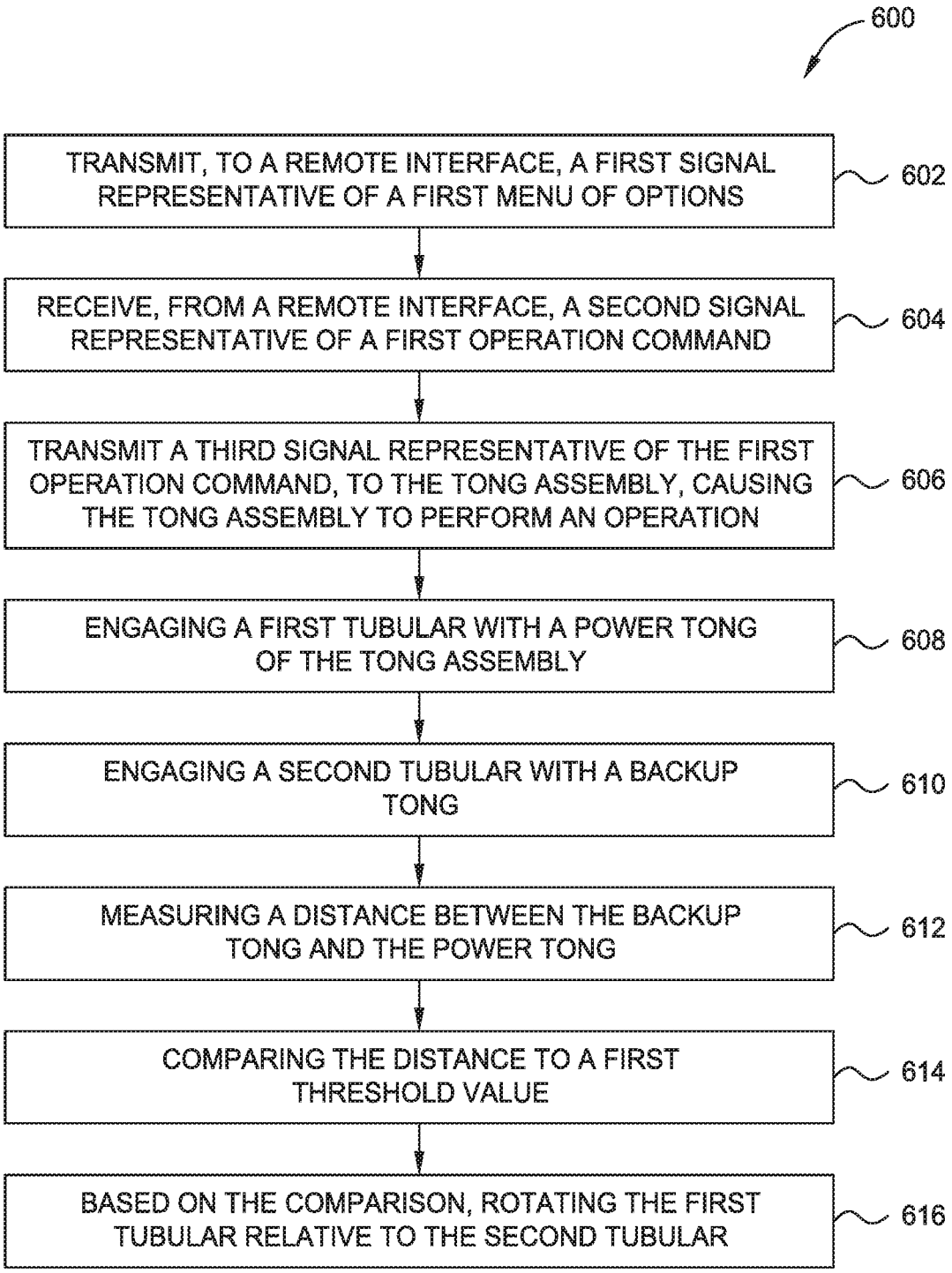
FIG. 6 illustrates another exemplary method utilizing a sensor system for a tong assembly.

FIG. 6 illustrates exemplary operations 600 that may be performed, for example, by a control device, such as local controller 140, to control the tong assembly at a work location, in accordance with embodiments of the present disclosure. Operations 600 begin at 602, where the control device transmits a first signal representative of a menu of options to a remote interface, such as remote controller 150.

The menu of options may, for example, represent operation commands for the tong assembly. At 604, the control device receives from the remote interface a second signal representative of a first operation command. At 606, the control device transmits a third signal representative of the first operation command to the tong assembly, which causes the tong assembly to operate and rotate the tubulars to make or break a connection. At 608, the power tong engages a first tubular. At 610, the backup tong engages a second tubular. At 612, the sensor system measures a distance between the backup tong and the power tong. At 614, the control device compares the measured distance to a first threshold value. At 616, the control device transmits a fifth signal to the tong assembly based on the comparison. If the measured distance is less than the first threshold value, then the tong assembly continues to operate and rotate the tubulars to make or break a connection. If the measured distance is equal to or greater than the first threshold value, then the fifth signal will cause the tong assembly stop operation. The fifth signal may be representative of a second operation command.

Operations 300, 400, 500, and/or 600 may further include one or more of the following steps: comparing the measured and/or monitored distance to a second threshold value; based on the second comparison, stopping rotation of the first threaded tubular relative to the second threaded tubular; disengaging the first threaded tubular from the power tong; disengaging the second threaded tubular from the backup tong; moving the power tong relative to the backup tong; re-engaging the first threaded tubular with the power tong; re-engaging the second threaded tubular with the backup tong; and further rotating the first threaded tubular relative to the second threaded tubular.

Operations 300, 400, 500, and/or 600 may further include one or more of the following steps: while further rotating the first threaded tubular relative to the second threaded tubular, measuring the distance between the backup tong and the power tong; after stopping rotation, comparing the distance to a second threshold value; based on the second comparison, restarting rotation of the first tubular relative to the second tubular; wherein comparing the distance to a first threshold value further comprises determining whether the distance is within one inch of the first threshold value; and wherein moving the power tong relative to the backup tong further comprises biasing the backup tong towards a neutral position.

In one or more of the embodiments described herein, a method of connecting or disconnecting a first tubular to a second tubular includes engaging the first tubular with a power tong; engaging the second tubular with a backup tong; and rotating the first tubular relative to the second tubular. The method also includes, while rotating, monitoring a distance between the backup tong and the power tong and comparing the distance to a first threshold value; and stopping rotation of the first tubular when the distance equals to the first threshold value.

In one or more of the embodiments described herein, the method further includes comparing the distance to a second threshold value.

In one or more of the embodiments described herein, the method further comprising based on the comparison, stopping rotation of the first threaded tubular relative to the second threaded tubular.

In one or more of the embodiments described herein, the method further including disengaging the first threaded tubular from the power tong; disengaging the second threaded tubular from the backup tong; and moving the power tong relative to the backup tong.

In one or more of the embodiments described herein, the method further including re-engaging the first threaded tubular with the power tong; re-engaging the second threaded tubular with the backup tong; and further rotating the first threaded tubular relative to the second threaded tubular.

In one or more of the embodiments described herein, the method further comprising while further rotating the first threaded tubular relative to the second threaded tubular, measuring the distance between the backup tong and the power tong.

In one or more of the embodiments described herein, a tong assembly, comprising: a power tong; a backup tong; a sensor configured to measure a distance between the power tong and the backup tong; and a controller configured to compare the distance to a threshold value.

In one or more of the embodiments described herein, wherein the sensor is an optical sensor.

In one or more of the embodiments described herein, wherein the sensor is a cable actuated sensor.

In one or more of the embodiments described herein, a method of connecting or disconnecting a first threaded tubular to a second threaded tubular includes engaging the first threaded tubular with a power tong, engaging the second threaded tubular with a backup tong, moving the power tong axially relative to the backup tong while rotating the first threaded tubular relative to the second threaded tubular; measuring a distance between the backup tong and the power tong; comparing the distance to a first threshold value; and stopping axial movement of the power tong when the distance reaches the first threshold value.

In one or more of the embodiments described herein, a method of connecting or disconnecting a first threaded tubular to a second threaded tubular includes engaging the first threaded tubular with a power tong, engaging the second threaded tubular with a backup tong, measuring a distance between the backup tong and the power tong, comparing the distance to a first threshold value, and based on the comparison, rotating the first threaded tubular relative to the second threaded tubular, thereby connecting or disconnecting the tubulars.

In one or more of the embodiments described herein, the method further includes, after stopping rotation, comparing the distance to a second threshold value.

In one or more of the embodiments described herein, the method further includes stopping axial movement of the power tong when the distance reaches the second threshold value.

In one or more of the embodiments described herein, wherein the first threshold value is within a predetermined range of an upper limit of movement of the backup tong relative to the power tong.

In one or more of the embodiments described herein, wherein the first threshold value is within a predetermined range of a lower limit of movement of the backup tong relative to the power tong.

In one or more of the embodiments described herein, wherein the second threshold value is a remaining distance for connecting or disconnecting the first tubular and the second tubular.

In one or more of the embodiments described herein, wherein comparing the distance to a first threshold value further comprises determining whether the distance is within one inch of the first threshold value.

In one or more of the embodiments described herein, the method further including disengaging the first threaded tubular from the power tong; disengaging the second threaded tubular from the backup tong; and moving the power tong relative to the backup tong.

In one or more of the embodiments described herein, the method further including re-engaging the first threaded tubular with the power tong; re-engaging the second threaded tubular with the backup tong; and further rotating the first threaded tubular relative to the second threaded tubular.

In one or more of the embodiments described herein, a tong assembly includes a power tong, a backup tong, a sensor configured to measure a distance between the power tong and the backup tong, and a controller configured to compare the distance to a threshold value.

In one or more of the embodiments described herein, wherein moving the power tong relative to the backup tong further comprises biasing the backup tong towards a neutral position.

In one or more of the embodiments described herein, wherein the sensor is an ultrasonic sensor.

While the foregoing is directed to embodiments of the present disclosure, other and further embodiments of the disclosure may be devised without departing from the basic scope thereof, and the scope thereof is determined by the claims that follow.

The invention claimed is:

1. A method of connecting or disconnecting a first tubular to a second tubular, comprising:
- engaging the first tubular with a power tong;
- engaging the second tubular with a backup tong;
- rotating the first tubular relative to the second tubular;
- while rotating:
  - measuring a distance between the power tong and the backup tong using a cable actuated sensor, wherein the cable actuated sensor includes a reel having a cable with a distal end, wherein:
    - either the reel is attached to the power tong and the distal end is attached to the backup tong or the reel is attached to the backup tong and the distal end is attached to the power tong;
  - utilizing a controller to monitor the distance between the backup tong and the power tong;
  - comparing the distance to a first distance threshold value, wherein the first distance threshold value is a predetermined value, wherein the predetermined value is about one inch from an upper limit of movement of the power tong relative to the backup tong or a lower limit of movement of the power tong relative to the backup tong;
- stopping rotation of the first tubular when the distance equals to or greater than the first distance threshold value;
- comparing the distance to a second distance threshold value, wherein the second distance threshold value is a remaining distance for connecting or disconnecting the first tubular and the second tubular; and
- restarting rotation of the first tubular relative to the second tubular if the distance is greater than or equal to the second distance threshold value.

2. The method of claim 1, further comprising:
- disengaging the first threaded tubular from the power tong if the distance is less than the second distance threshold value;
- disengaging the second threaded tubular from the backup tong; and
- moving the power tong relative to the backup tong.

3. The method of claim 2, further comprising:
- re-engaging the first threaded tubular with the power tong;
- re-engaging the second threaded tubular with the backup tong; and
- further rotating the first threaded tubular relative to the second threaded tubular.

4. The method of claim 1, further comprising:
- repositioning the backup tong axially relative to the power tong if the distance is less than the second distance threshold value.

5. The method of claim 1, wherein the first distance threshold value is based on a specification of each of the first tubular, the second tubular, the power tong, and the backup tong.

6. A method of connecting or disconnecting a first threaded tubular to a second threaded tubular, comprising:
- engaging the first threaded tubular with a power tong;
- engaging the second threaded tubular with a backup tong;
- moving the power tong axially relative to the backup tong while rotating the first threaded tubular in a first direction relative to the second threaded tubular;
- measuring a distance between the backup tong and the power tong, the distance measured using a cable actuated sensor, wherein the cable actuated sensor includes a reel having a cable with a distal end, wherein:
  - either the reel is attached to the power tong and the distal end is attached to the backup tong or the reel is attached to the backup tong and the distal end is attached to the power tong;
- comparing the distance to a first distance threshold value;
- stopping axial movement of the power tong when the distance reaches the first distance threshold value;
- changing a position of the power tong relative to the backup tong such that a distance between the power tong and backup tong is greater than or equal to a remaining distance for connecting or disconnecting the first tubular and the second tubular; and
- restarting rotation of the first tubular in the first direction relative to the second tubular after changing the position of the power tong relative to the backup tong.

7. The method of claim 6, wherein changing the position of the power tong relative to the backup tong includes:
- disengaging the first threaded tubular from the power tong;
- disengaging the second threaded tubular from the backup tong; and
- moving the power tong relative to the backup tong.

8. The method of claim 7, further comprising:
- re-engaging the first threaded tubular with the power tong;
- re-engaging the second threaded tubular with the backup tong.

9. The method of claim 7, wherein moving the power tong relative to the backup tong further comprises biasing the backup tong towards a neutral position.

10. The method of claim 8, further comprising while further rotating the first threaded tubular relative to the second threaded tubular, measuring the distance between the backup tong and the power tong.

11. A method of connecting or disconnecting a first tubular to a second tubular, comprising:
- engaging the first tubular with a power tong;
- engaging the second tubular with a backup tong;
- rotating the first tubular relative to the second tubular;
- while rotating:
  - measuring a distance between the power tong and the backup tong using a cable actuated sensor, wherein the cable actuated sensor includes a reel having a cable with a distal end, wherein:

either the reel is attached to the power tong and the distal end is attached to the backup tong or the reel is attached to the backup tong and the distal end is attached to the power tong; and utilizing a controller to monitor the distance between the backup tong and the power tong, wherein:

if the distance is greater than or equal to a remaining distance for connecting or disconnecting the first tubular and the second tubular, then:

rotating the first tubular relative to the second tubular to complete the connecting or disconnecting of the first and second tubulars;

if the distance is less than the remaining distance for connecting or disconnecting the first tubular and the second tubular, then:

stopping rotation of the first tubular relative to the second tubular;

repositioning the backup tong axially relative to the power tong; and restarting rotation of the first tubular relative to the second tubular.

12. The method of claim 11, wherein the rotating of the first tubular relative to the second tubular to complete the connecting or disconnecting of the first and second tubulars comprises maintaining rotation of the first tubular relative to the second tubular.

* * * * *